US007462062B2

(12) United States Patent
Kumakura

(10) Patent No.: US 7,462,062 B2
(45) Date of Patent: Dec. 9, 2008

(54) CRIMPING TERMINAL AND FLAT CIRCUITRY HAVING SAME

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/591,558

(22) Filed: Nov. 2, 2006

(65) Prior Publication Data

US 2007/0111613 A1 May 17, 2007

(30) Foreign Application Priority Data

Nov. 14, 2005 (JP) ..... 2005-328437

(51) Int. Cl.
*H01R 4/24* (2006.01)

(52) U.S. Cl. ..... 439/422; 439/877

(58) Field of Classification Search ..... 439/423, 439/422, 877

See application file for complete search history.

(56) References Cited

U.S. PATENT DOCUMENTS 3,758,703 A * 9/1973 Golden et al. ..... 174/84 C
3,932,018 A * 1/1976 Parsons et al. ..... 439/422
3,960,430 A * 6/1976 Bunnell et al. ..... 439/422
4,082,402 A * 4/1978 Kinkaid et al. ..... 439/422
4,938,713 A * 7/1990 Daly et al. ..... 439/492
5,078,617 A * 1/1992 Gutierrez et al. ..... 439/422
5,299,954 A * 4/1994 Ishii ..... 439/422
5,370,560 A * 12/1994 Ito ..... 439/877
6,068,505 A * 5/2000 Sai ..... 439/422
6,135,779 A * 10/2000 Koch et al. ..... 439/42
6,341,980 B1 * 1/2002 Hio et al. ..... 439/422
6,350,145 B1 * 2/2002 Chen et al. ..... 439/422
6,364,691 B1 * 4/2002 Hio ..... 439/422
6,375,492 B1 * 4/2002 Hio ..... 439/422
2002/0022414 A1 * 2/2002 Kitagawa et al. ..... 439/877
2002/0132534 A1 * 9/2002 Serbin et al. ..... 439/877
2003/0013353 A1 * 1/2003 Sakaguchi et al. ..... 439/877
2004/0063351 A1 * 4/2004 Enomoto et al. ..... 439/422
2007/0077807 A1 * 4/2007 Kumakura ..... 439/422

FOREIGN PATENT DOCUMENTS

EP 1 363 362 A1 11/2003
JP 2002-334733 11/2002

* cited by examiner

*Primary Examiner*—T C Patel
*Assistant Examiner*—Vladimir Imas
(74) *Attorney, Agent, or Firm*—Kratz, Quintos & Hanson, LLP

(57) ABSTRACT

The present invention is to provide a terminal for a flat circuitry. The terminal assuredly crimps a conductor of the flat circuitry and provides an improved electric connection. An electric connection portion of a crimping terminal includes a bottom wall for placing a flat conductor of a FFC and a pair of conductor crimping pieces. The conductor crimping pieces are upstanding at both ends of the bottom wall for crimping the conductor. A plurality of serrations are disposed outside ends of the conductor placed on the bottom wall of the electric connection portion and arranged in series with a distance between the serrations. The conductor crimping pieces start to deform at the serrations, or the best deforming position, for crimping the conductor.

6 Claims, 5 Drawing Sheets

CRIMPING TERMINAL AND FLAT CIRCUITRY HAVING SAME

BACKGROUND OF THE INVENTION

1. Field of the Invention

The present invention relates to a terminal attached to a flat conductor of a flat circuitry such as FPC (Flexible Print Circuit) and FFC (Flexible Flat Cable), and the flat circuitry having the terminal.

2. Description of the Related Art

A motor vehicle is equipped with a variety of electronic devices. The motor vehicle includes a wire harness for supplying electric power of a battery and control signal of a controller to the electronic devices. The wire harness has an electric wire and a connector. The connector has a housing formed with a synthetic resin and a terminal connected with an end portion of the electric wire.

The electronic devices mounted in the motor vehicle has been increasing in accordance with multi-functions requested by users. Accordingly, the wire harness has also been increasing in mass and volume.

In order to make the wire harness smaller, the flat circuitry such as FFC and FPC is proposed as the electric wire. The flat circuitry has a conductor of a rectangle section and a clad portion covering the conductor. The flat circuitry has the plurality of the conductors extending in parallel each other and the conductors are each insulated with the clad portion.

EP1363362 discloses that when a terminal is connected to a conductor of a flat circuitry, the conductor is bent to match with a shape of the terminal and the terminal is connected to the conductor. JP,2002-334733,A discloses that a conductor is placed on a bottom wall of a terminal having a pair of crimping pieces upstanding at both ends of the bottom wall and electric connection portions are bent to crimp the conductor.

A method of connecting the terminal to the conductor disclosed in EP1363362 requires a metal mold to form the conductor so as to match the shape of the terminal, and a metal mold for crimping the terminal to the conductor. Accordingly, a cost of connecting the terminal tends to increase.

The electric connection portion disclosed in JP,2002-334733,A can not be matched with the flat conductor due to the flat shape contrary to the case of twisted electric wires. Then, a contact area between the conductor and the electric connection portion decreases and an electric contact failure easily occurs. The electric connection portion has usually the crimping pieces, end portions of which are widely opened up to easily accept the conductor. This causes a difficulty for the crimping pieces to deform at a prescribed position when the conductor is crimped with a crimping device. Accordingly, the conductor is not well crimped as a specification so that the contact failure occurs due to an weak crimping force. Since the end portions of the crimping pieces are widely opened up, the conductor is easily displaced against the electric connection portion and possibly left therefrom during crimping.

SUMMARY OF THE INVENTION

The present invention provides a terminal for crimping a conductor of a flat circuitry without slipping the conductor from the terminal and with a reliable and improved crimping, and provides the flat circuitry having the terminal.

According to a first aspect of the present invention, a crimping terminal includes an electric contact portion; an electric connection portion connected with the electric contact portion, the electric connection portion having a pair of conductor crimping pieces upstanding at both ends of a bottom wall and having serrations disposed on an inner wall of the pair of conductor crimping pieces and extending along a longitudinal direction of the crimping terminal; and a pair of clad crimping pieces connected with the electric connection portion, wherein a conductor with a flat shape of a flat circuitry is placed on the bottom wall and is crimped around with the pair of the conductor crimping pieces.

Preferably, the serrations are disposed away from abutting portions of the conductor to the inner wall of the pair of the conductor crimping pieces with respect to the bottom wall prior to crimping the conductor.

Preferably, the plurality of the serrations are disposed in series with a distance therebetween along the longitudinal direction of the crimping terminal.

According to a second aspect of the present invention, a flat circuitry having a crimping terminal includes: said flat circuitry having a conductor with a flat shape; and said crimping terminal, the crimping terminal including: an electric contact portion; an electric connection portion connected with the electric contact portion, said electric connection portion having a pair of conductor crimping pieces upstanding at both ends of a bottom wall and having serrations disposed on an inner wall of the pair of conductor crimping pieces and extending along a longitudinal direction of the crimping terminal; and a pair of clad crimping pieces connected with the electric connection portion, wherein the conductor with the flat shape of the flat circuitry is placed on the bottom wall and is crimped around with the pair of the conductor crimping pieces.

Preferably, the plurality of the serrations are disposed in series with a distance therebetween along the longitudinal direction of the crimping terminal.

DETAILED DESCRIPTION OF THE PREFERRED EMBODIMENT

Figure 1:
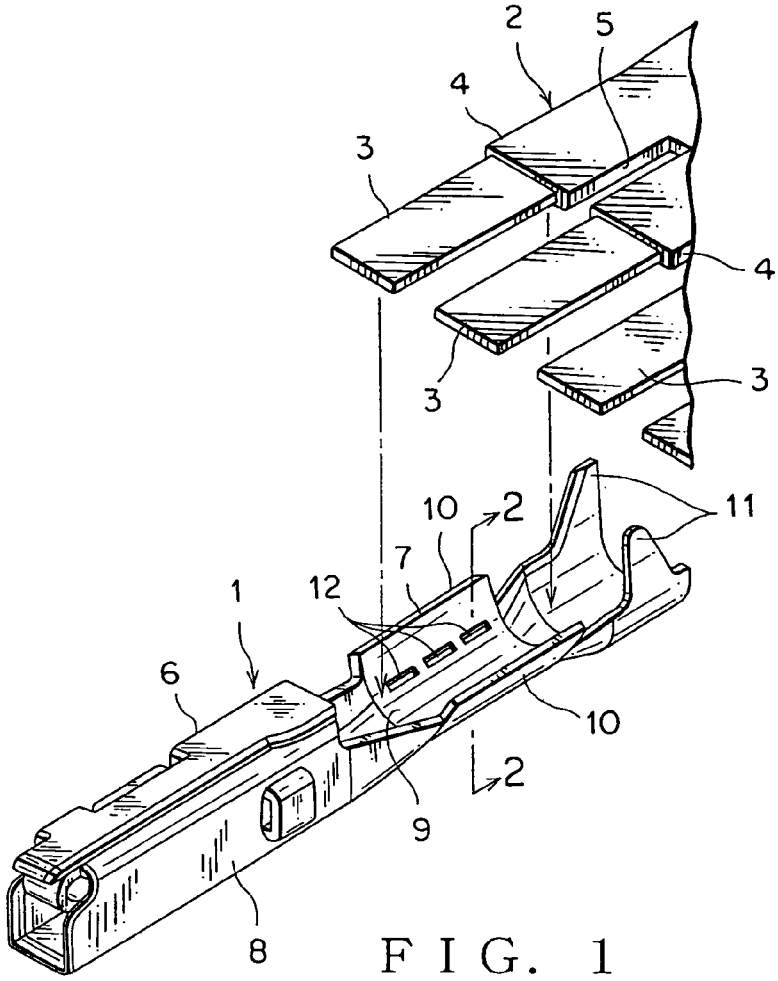
FIG. 1 is a perspective view showing an embodiment of a flat circuitry having a crimping terminal of the present invention.

A flat circuitry having a terminal 20 includes a crimping terminal 1 and a FFC (Flexible Flat Cable) 2 as the flat circuitry, as shown in FIG. 1, wherein the crimping terminal 1 is connected to an end portion of the FFC 2. The FFC 2 has a plurality of conductors 3 and clad portions 4 covering the conductors 3. The FFC 2 has a belt-shape. The conductors 3 are made of a conductive metal containing at least copper or a copper alloy. The conductors 3 have a rectangle crosssection and extend parallel each other. The clad portions 4 are made of a synthetic resin insulator having a belt-shape and cover separately the plurality of the conductors 3 for electric insulation. The FFC 2 has the plurality of the conductors 3 at an end thereof where the clad portions 4 are removed. The conductors 3 are separated with slits 5 each other. In the present invention, the flat circuitry means that the circuitry has a plurality of conductors and insulating clad portions and is belt shaped.

The crimping terminal 1 is formed by bending a conductive sheet metal and has an electric contact portion 6 for connecting a mating terminal and an electric connection portion 7 for crimping the conductors 3 of the FFC 2.

The electric contact portion 6 has a rectangular-section tube 8 and a spring, not shown, received in the tube 8. The tube 8 has a square-section in FIG. 1. When an insertion piece such as a male tab of a mating terminal is inserted into the tube 8, the spring presses the male tab toward an inner wall of the tube 8 to hold the male tab in order for electrically and mechanically connecting the mating terminal.

Figure 2:
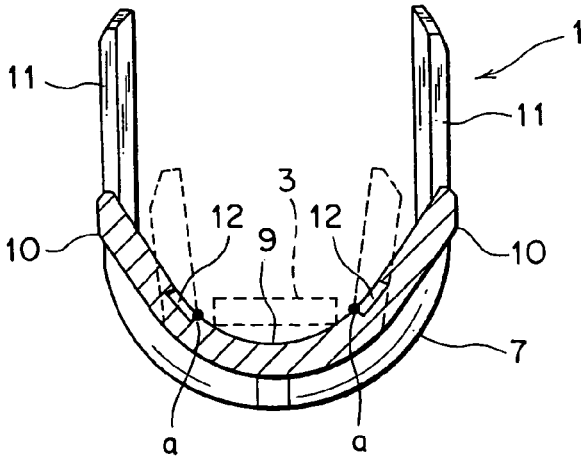
FIG. 2 is a sectional view taken along a line 2-2 of the flat circuitry having the crimping terminal of FIG. 1.

As shown in FIG. 2, the electric connection portion 7 has a bottom wall 9 with a circular-section, a pair of conductor crimping pieces 10, a pair of clad crimping pieces 11, and a plurality of serrations 12.

The bottom wall 9 is connected to an outer wall of the tube 8. The conductor 3 disposed at the end of the FFC 2 is placed on the bottom wall 9.

The conductor crimping pieces 10 form crimping pieces in the present invention. The pair of the conductor crimping pieces 10 are disposed at the center of the bottom wall 9 and upstanding at both sides in a direction of width of the bottom wall 9. The conductor crimping pieces 10 are opened up toward ends thereof prior to crimping the conductor 3 for easy amount of the conductor 3. The conductor crimping pieces 10 are connected to the bottom wall 9 with a smooth curve without a corner. The ends of the conductor crimping pieces 10 are bent toward the bottom wall 9 to sandwich the conductor 3 of the FFC 2.

The clad crimping pieces 11 are disposed opposite to the electric contact portion 6 with respect to the bottom wall 9. The clad crimping pieces 11 are disposed in the direction of width of the bottom wall 8 and upstanding at the both ends thereof. Ends of the clad crimping pieces 11 are bent toward the bottom wall 9 to sandwich the clad portion 4 of the FFC 2.

Figure 3:
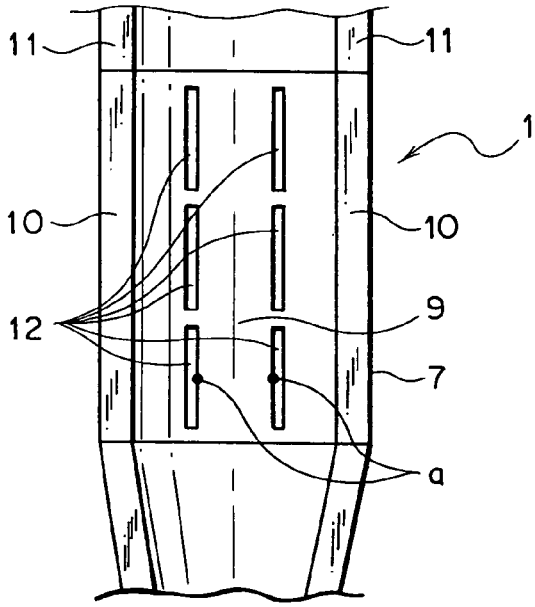
FIG. 3 is a front view of the crimping terminal of FIG. 1 prior to crimping a conductor of the flat circuitry.
Figure 4:
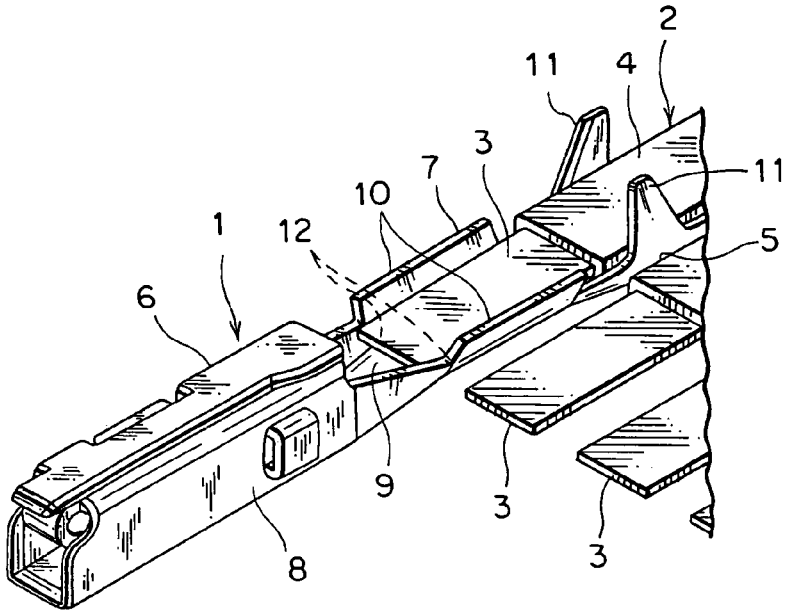
FIG. 4 is a perspective view showing that an end portion of the flat circuitry is placed on crimping pieces.

The serrations 12 are formed with recesses disposed at an inner wall of the conductor crimping pieces 10 and have grooves extending into a longitudinal direction of the crimping terminal 1. As shown in FIG. 2, the serrations 12 are disposed away from abutting portions of the conductor to the inner wall of the conductor crimping pieces 10 with respect to the bottom wall 9 prior to crimping the conductor 3. The conductor crimping pieces 10 are opened up at the ends thereof prior to crimping. A width of face-to-face serrations 12 is wider than that of the conductor 3. The serrations 12 are disposed in the direction of width of the conductor 3 and outside the ends thereof. The plurality of the serrations 12 are disposed in series with a distance therebetween along a longitudinal direction of the crimping terminal 1. In FIGS. 2 and 3, a reference sign a denotes the best deforming position of the conductor crimping pieces 10 of the crimping terminal 1. When the crimping terminal 1 starts to deform at the best deforming positions a, an enough crimping force is attained to achieve the best crimping shape. The serrations 12 are formed at the best deforming positions a.

When the conductor crimping pieces 10 are bent with a crimping device 15 as described later, they start to deform at the best deforming positions a, or the serrations 12. The serrations 12 reduce the thickness, i.e. strength of the conductor crimping pieces 10.

When the conductor crimping pieces 10 having the serrations 12 are crimped with the crimping device 15, edge portions disposed between the serrations 12 and extending to the direction of width of the crimping terminal 1 bite into the conductor 3. Accordingly, the conductor 3 is prevented from slipping out of the electric connection portion 7 and resulting to an improved connection between the crimping terminal 1 and the conductor 3.

In the flat circuitry, such as the FFC 2, having a terminal 20, the end portions of the FFC 2 each are placed on the bottom wall 9 of the crimping terminal 1 and the conductor 3 and clad portion 4 of the FFC 2 are crimped with the crimping pieces 10 and 11 by utilizing the crimping device 15. Accordingly, the crimping terminal 1 and the end portions of the FFC 2 are electrically and mechanically connected.

Figure 6:
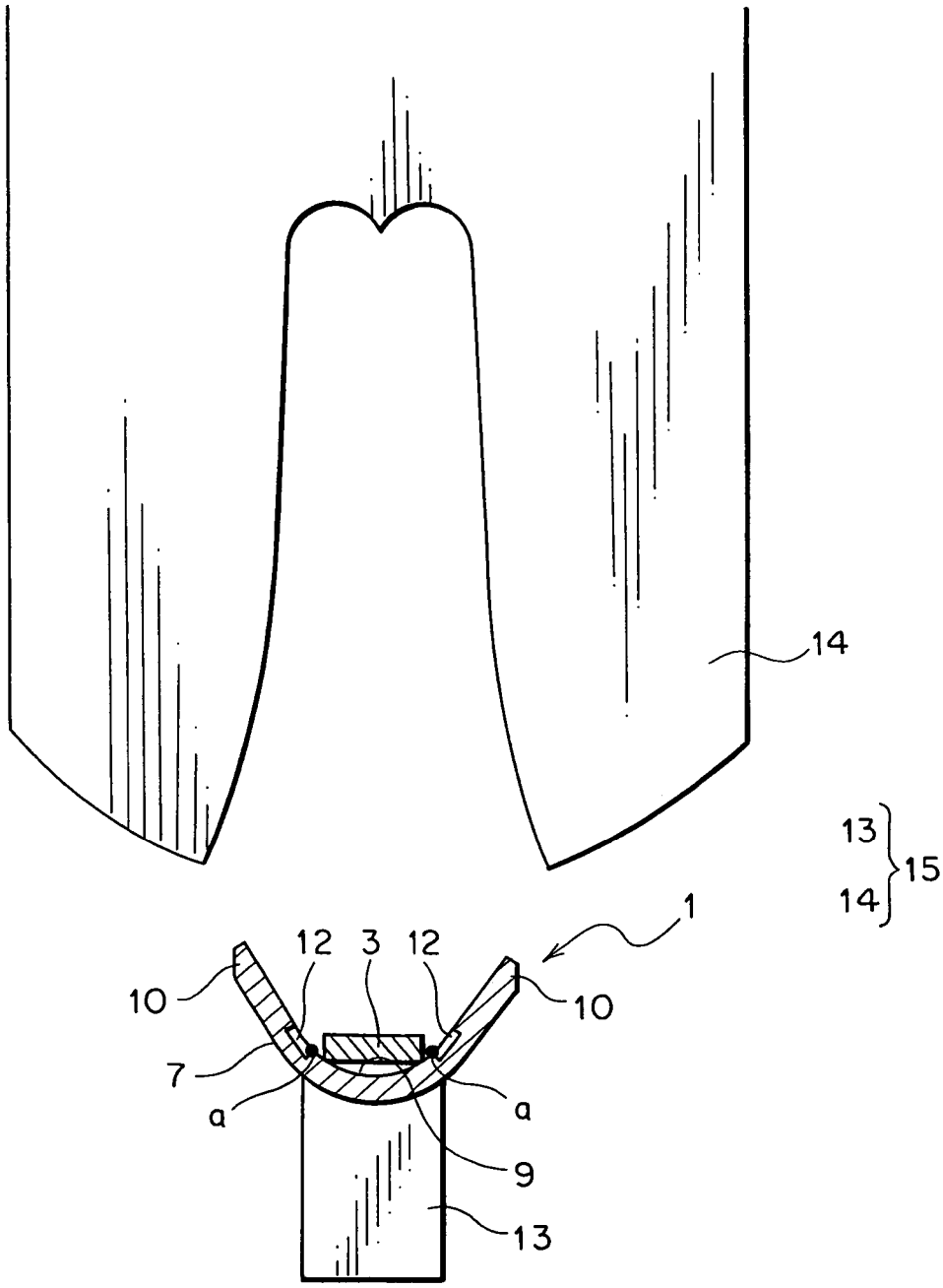
FIG. 6 illustrates that the crimping terminal and the conductor of the flat circuitry are set in a crimping device.

As shown in FIG. 6, the crimping device 15 has a main body, not shown, an anvil 13, and a crimper 14. The main body is installed on a floor of a factory. The anvil 13 is fixed to the main body and receives the crimping terminal 1 thereon. The crimper 14 is supported with the main body and is opposed to the anvil 13 and can come close to or off from the anvil 13. When the anvil 13 and crimper 14 are separated each other, the crimping terminal 1 and the end portion of the FFC 2 are placed on the anvil 13. The anvil 13 and crimper 14 come close to each other to sandwich the crimping terminal 1 and the end portion of the FFC 2 and to crimp them with the crimping pieces 10 and 11.

FIGS. 6-9 illustrate how the conductor crimping pieces 10 of the crimping terminal 1 crimp the conductor 3 of the FFC 2 with the crimping device 15.

As shown in FIG. 6, the anvil 13 and the crimper 14 are separated each other. The crimping terminal 1 is placed on the anvil 13. The end portion of the FFC 2, or the conductor 3 is placed on the bottom wall 9 of the crimping terminal 1 and positioned between the pair of the conductor crimping pieces 10.

Figure 7:
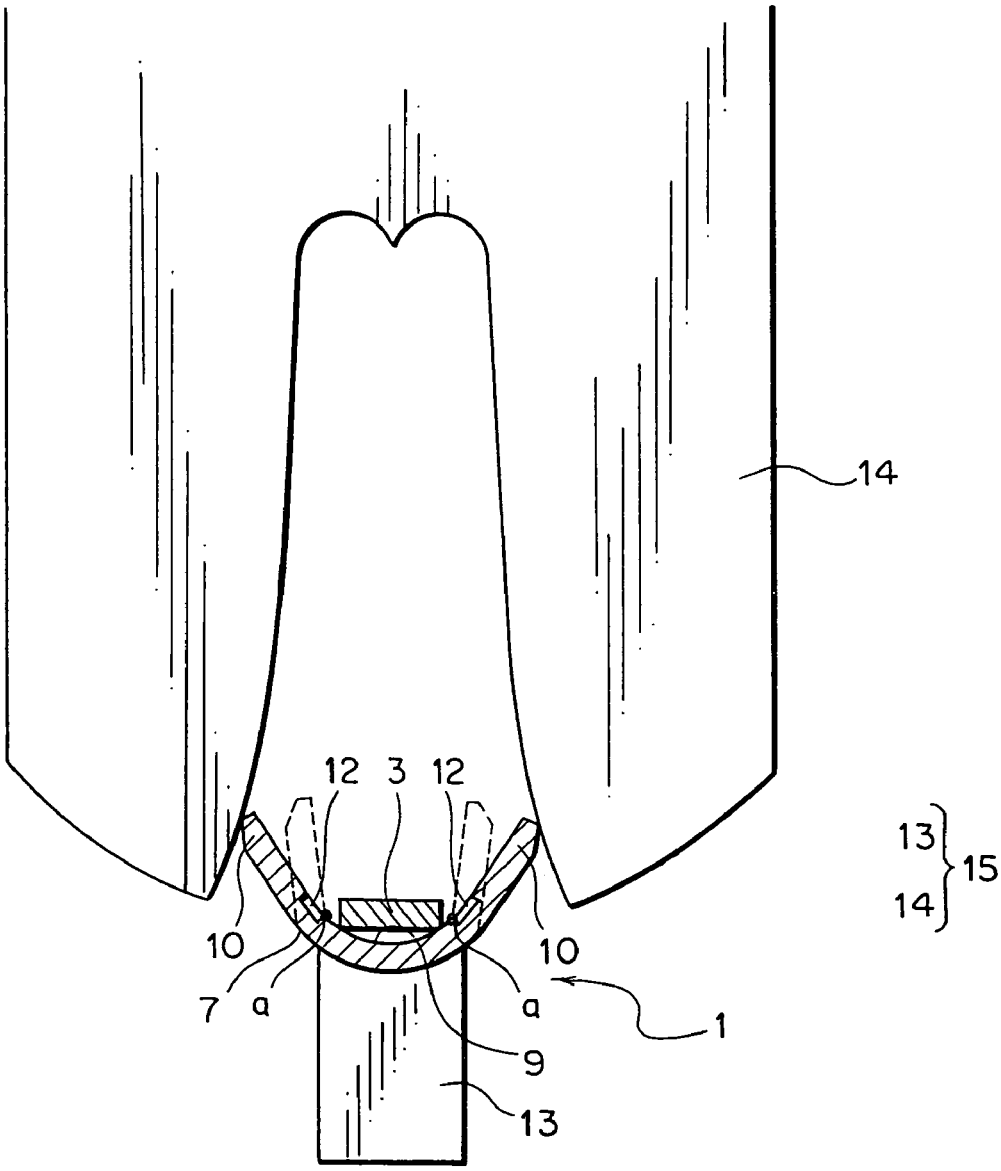
FIG. 7 illustrates that ends of the crimping pieces abut to a crimper of the crimping device and start to deform.

As shown in FIG. 7, the crimper 14 approaches to the anvil 13 and the crimping terminal 1 enters into a recess of the crimper 14 and side walls of the recess abut to the ends of the conductor crimping pieces 10. The conductor crimping pieces 10 are subjected to an external force from the side walls of the recess. Accordingly, the conductor crimping pieces 10 start to deform toward and inside the crimping terminal 1 at the serrations 12, which are disposed in the direction of width of the conductor 3 and outside the ends of the conductor 3 placed on the bottom wall 9.

Figure 8:
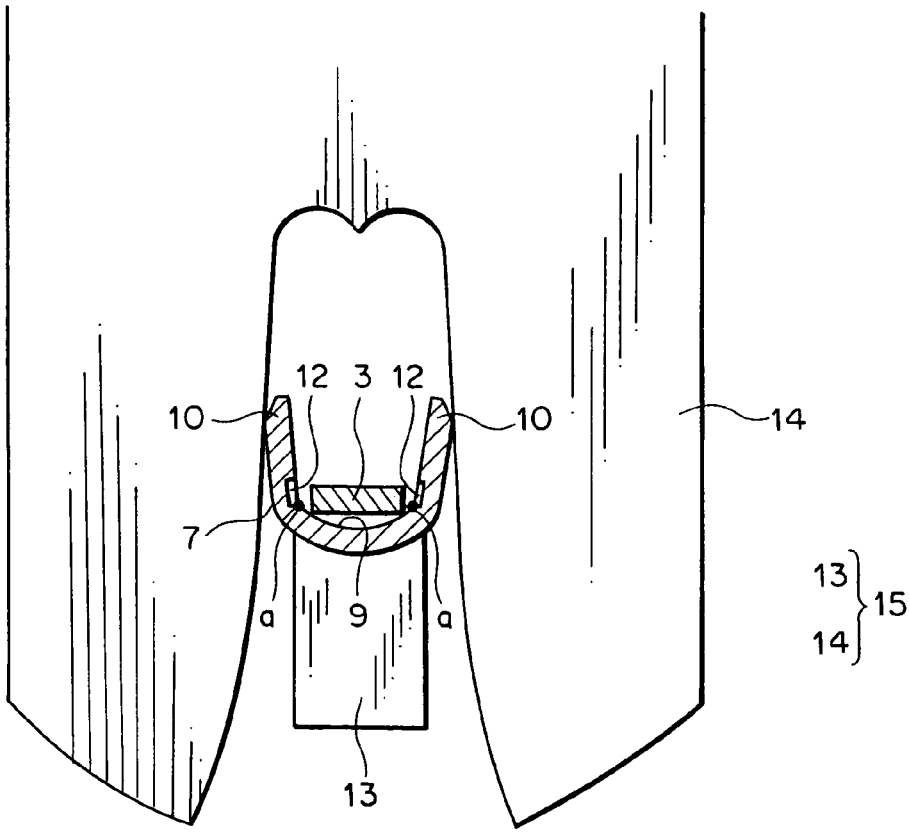
FIG. 8 illustrates that the crimping pieces further deform.
Figure 5:
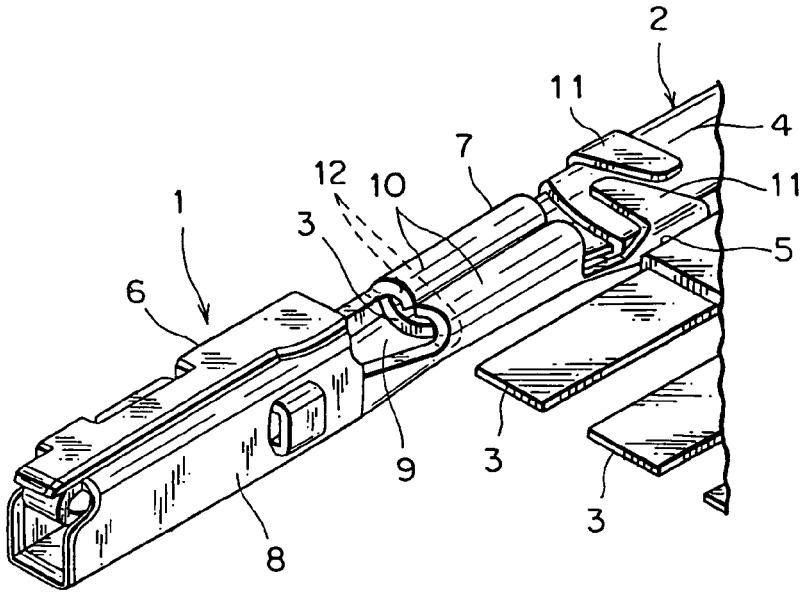
FIG. 5 is a perspective view showing that the end portion of the flat circuitry is crimped with the crimping pieces of FIG. 4.

As the crimper 14 comes more close to the anvil 13, the ends of the conductor crimping pieces 10 continue to deform while sliding on the side walls. As shown in FIG. 8, the conductor crimping pieces 10 deform at the outsides of the conductor 3 so that the conductor 3 does not lift from the bottom wall 9 or slip out of the electric connection portion 7.

Figure 9:
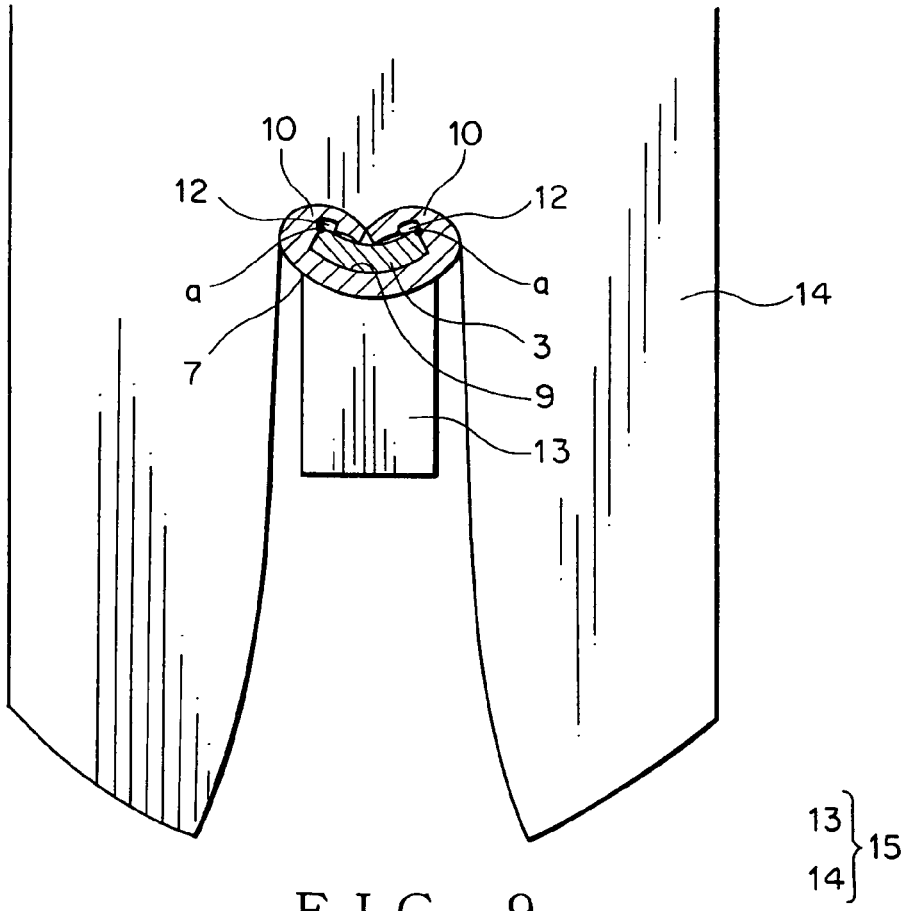
FIG. 9 illustrates that the crimping pieces crimp the conductor of the flat circuitry.

As shown in FIG. 9, the conductor crimping pieces 10 are bent along a bottom face of the crimper 14 and the ends thereof approach to the bottom wall 9 and sandwich the conductor 3 with the bottom wall 9. Accordingly, the conductor crimping pieces 10 of the crimping terminal 1 crimp the conductor 3 of the FFC 2 and resulting to the flat circuitry having the terminal 20.

The serrations 12 are disposed at the best deforming positions a and outside the ends of the conductor 3 so that the conductor crimping pieces 10 assuredly start to deform at the best deforming positions a. Accordingly, a contact failure due to an inadequate crimping force is avoided. The embodiment of the present invention provides the crimping terminal 1 having an improved connection to the flat circuitry.

The edge portions disposed between the serrations 12 and extending to the direction of width of the crimping terminal 1 bite into the conductor 3. Accordingly, the crimping terminal 1 of the present invention provides the improved holding force and electrical connection to the conductor 3 of the flat circuitry.

The embodiment of the present invention is adapted to the FFC 2 as the flat circuitry but also adapted to a belt-like flat circuitry such as the FPC (Flexible Print Circuit).

In the embodiment of the present invention, the electric contact portion 6 of the crimping terminal 1 is a female type such as the rectangular-section tube 8. The electric contact portion 6 can be a male type having a rod shape or plate shape.

In the embodiment of the present invention, the plurality of the serrations 12 are disposed close to the bottom wall 9 of the conductor crimping pieces 10 along the longitudinal direction of the crimping terminal 1. The serrations 12 can be formed in the bottom wall 9 or the clad crimping pieces 11.

The embodiment of the present invention is only exemplary and not limited thereto. Modifications are possible within the scope of the present invention.

What is claimed is:

1. A crimping terminal comprising:

an electric contact portion;

an electric connection portion connected with the electric contact portion, said electric connection portion having a pair of conductor crimping pieces upstanding at both ends of a bottom wall and each conductor crimping piece having a plurality of serrations disposed on an inner wall of each of the pair of conductor crimping pieces and extending in series in a single line along a longitudinal direction of the crimping terminal; and a pair of clad crimping pieces connected with the electric connection portion, wherein a conductor with a flat shape of a flat circuitry is placed on the bottom wall, with the plurality of serrations on the conductor crimping piece being provided only outside the sides of the conductor, and is crimped around with the pair of the conductor crimping pieces and the plurality of serrations promote deformation of the pair of conductor crimping pieces at a best deforming position.

2. The crimping terminal as claimed in claim 1, wherein said serrations are disposed away from abutting portions of the conductor to the inner wall of the pair of the conductor crimping pieces with respect to the bottom wall prior to crimping the conductor.

3. The crimping terminal as claimed in claim 1, wherein said plurality of the serrations are disposed in series with a distance therebetween along the longitudinal direction of the crimping terminal.

4. A flat circuitry having a crimping terminal comprising:

a conductor with a flat shape and said crimping terminal, the crimping terminal including:

an electric contact portion;

an electric connection portion connected with the electric contact portion, said electric connection portion having a pair of conductor crimping pieces upstanding at both ends of a bottom wall and each conductor crimping piece having a plurality of serrations disposed on an inner wall of each of the pair of conductor crimping pieces and extending in series in a single line along a longitudinal direction of the crimping terminal; and a pair of clad crimping pieces connected with the electric connection portion, wherein the conductor with the flat shape of the flat circuitry is placed on the bottom wall, with the plurality of serrations provided only outside the ends of the conductor, and is crimped around with the pair of the conductor crimping pieces and the plurality of serrations promote deformation of the pair of conductor crimping pieces at a best deforming position.

5. The flat circuitry having a crimping terminal as claimed in claim 4, wherein said plurality of serrations are disposed in series with a distance therebetween along the longitudinal direction of the crimping terminal.

6. The crimping terminal as claimed in claim 2, wherein said plurality of the serrations are disposed in series with a distance therebetween along the longitudinal direction of the crimping terminal.

* * * * *